US010313809B2

(12) United States Patent
Belhomme et al.

(10) Patent No.: US 10,313,809 B2
(45) Date of Patent: Jun. 4, 2019

(54) METHOD AND DEVICE FOR ESTIMATING ACOUSTIC REVERBERATION

(71) Applicant: INVOXIA, Issy les Moulineaux (FR)

(72) Inventors: Arthur Belhomme, Paris (FR); Yves Grenier, Magny les Hameaux (FR); Roland Badeau, Paris (FR); Eric Humbert, Boulogne Billancourt (FR)

(73) Assignee: INVOXIA, Issy Les Moulineaux (FR)

( * ) Notice: Subject to any disclaimer, the term of this patent is extended or adjusted under 35 U.S.C. 154(b) by 0 days.

(21) Appl. No.: 15/778,146

(22) PCT Filed: Nov. 21, 2016

(86) PCT No.: PCT/FR2016/053034

§ 371 (c)(1),
(2) Date: May 22, 2018

(87) PCT Pub. No.: WO2017/089688

PCT Pub. Date: Jun. 1, 2017

(65) Prior Publication Data

US 2018/0359582 A1 Dec. 13, 2018

(30) Foreign Application Priority Data

Nov. 26, 2015 (FR) ..... 15 61404

(51) Int. Cl.

| | |
|---|---|
| ***H04R 29/00*** | (2006.01) |
| ***H04S 7/00*** | (2006.01) |
| ***G10L 25/21*** | (2013.01) |

(52) U.S. Cl.

CPC ..... *H04R 29/001* (2013.01); *G10L 25/21* (2013.01); *H04R 29/00* (2013.01); *H04S 7/00* (2013.01)

(58) Field of Classification Search

CPC ..... H04R 29/001; H04S 7/00; H04S 7/301; G10L 25/21

See application file for complete search history.

(56) References Cited

U.S. PATENT DOCUMENTS 9,607,627 B2 * 3/2017 Liang ..... G10L 21/0208
2004/0213415 A1 * 10/2004 Rama ..... G01H 7/00 381/63

(Continued)

FOREIGN PATENT DOCUMENTS

EP 1 885 154 A1 2/2008
EP 2 058 804 A1 5/2009

OTHER PUBLICATIONS

International Search Report related to Application No. PCT/FR2016/053034; dated Mar. 23, 2017.

(Continued)

*Primary Examiner* — Jason R Kurr
(74) *Attorney, Agent, or Firm* — Miller, Matthias & Hull LLP

(57) ABSTRACT

A method for estimating the acoustic reverberations in an environment comprising the following steps: a measurement step in which one acoustic signal emitted in the environment is captured; a step for determination of acoustic energy decay rate distribution during which an acoustic energy decay rate distribution is determined from the acoustic signal captured in step (a); an estimation step during which a reverberation time and a reverberation level of sound in the environment are estimated by regression from the characteristic function of the acoustic energy decay rate distribution determined in step (b).

9 Claims, 1 Drawing Sheet

(56) References Cited

U.S. PATENT DOCUMENTS

| | | | | |
|---|---|---|---|---|
| 2006/0222172 | A1 | 10/2006 | Chhetri et al. | |
| 2009/0010443 | A1* | 1/2009 | Ahnert | G01H 7/00 381/59 |
| 2014/0169575 | A1 | 6/2014 | Gao et al. | |
| 2017/0303053 | A1* | 10/2017 | Falch | G10L 21/02 |

OTHER PUBLICATIONS

Tiago Falk, et al: "Temporal Dynamics for Blind Measurement of Room Acoustical Parameters", IEEE Transaction on Instrumentation and Measurement, Mar. 20, 2010, pp. 978-989, vol. 59, No. 4, IEEE Service Center, Piscataway, New Jersey, USA.

James Eaton, et al: "Noise-Robust Reverberation Time Estimation Using Spectral Decay Distribution With Reduced Computational Cost", IEEE International Conference on Acoustics, Speech and Signal Processing; May 26-31, 2013, pp. 161-165, Institute of Electrical and Electronics Engineers, Piscataway, New Jersey, USA.

Charles-Henri Kempeners: "Quelques Modèles De Regression", Oct. 11, 2010, pp. 1-11.

Bernhard Schölkopf, et al: "Learning with Kernels", Massachusetts Institute of Technology, Mar. 2, 2001, pp. 1-26, The MIT Press, Cambridge, Massachuetts, London, England.

Jimi Y.C. Wen, et al: "Evaluation of Speech Dereverberation Algorithms Using the Mardy Database", IWAENC, Sep. 12-14, 2006, pp. 1-4, Department of Electrical and Electronic Engineering, Imperial College London, London, United Kingdom.

Jimi Y.C. Wen, et al: "Blind Estimation of Reverberation Time Based on the Distribution of Signal Decay Rates", ICASSP, Mar. 31, 2008, pp. 329-332, Department of EEE Imperial College, London, United Kingdom.

Yonggang Zhang, et al: "Blind Estimation of Reverberation Time in Occupied Rooms", EUSIPCO 14 European Signal Processing Conference; Sep. 4-8, 2006, The Centre of Digital Signal Processing, Cardiff School of Engineering, Cardiff, United Kingdom.

Fatiha Alabau-Boussouira, et al: "A General Method for Proving Sharp Energy, Decay Rates for Memory-Dissipative Evolution Equations", C.R. Academie des Sciences, May 15, 2009, pp. 867-872, Partial Differential Equations/Optimal Control, Roma, Italy.

Andrey Feuerverger, et al: "The Empirical Characteristic Function and Its Applications", The Annals of Statistics, Sep. 25, 2003, pp. 88-97, vol. 5, No. 1, The Institute of Mathematical Statistics.

Manfred R. Schroeder (New Method of Measuring Reverberation Time, The Journal of the Acoustical Society of America, 37(3):409, 1965).

P.A. Naylor and N. D. Gaubitch (Speech Dereverberation, Springer, Eds., edition, 2010).

* cited by examiner

FIG. 1
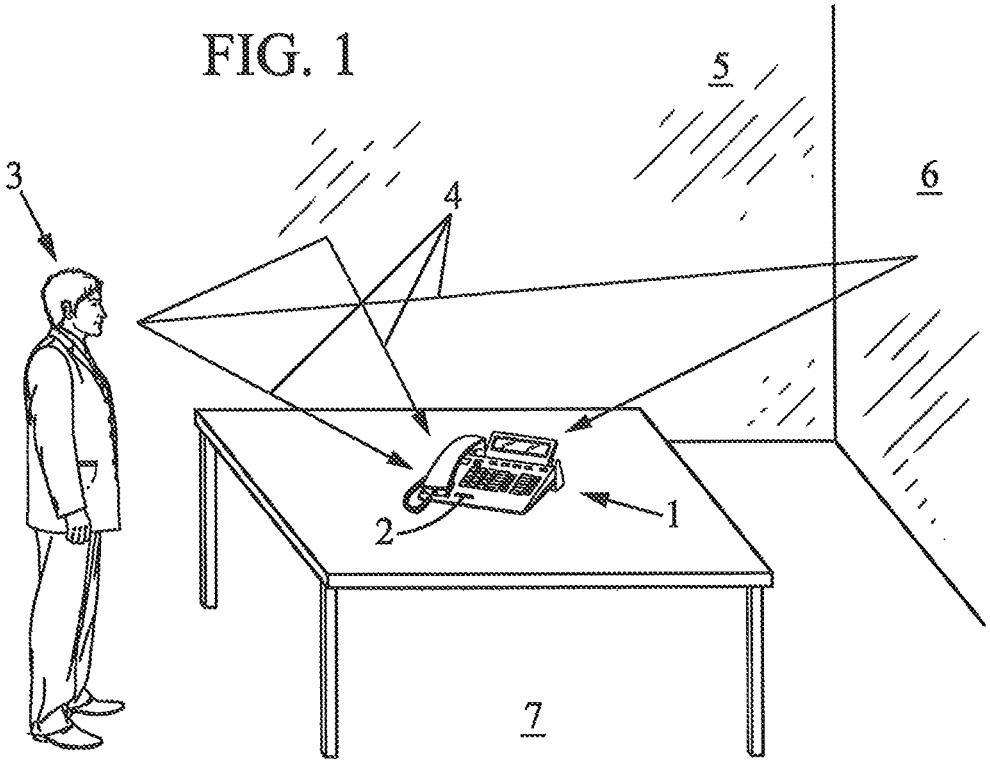
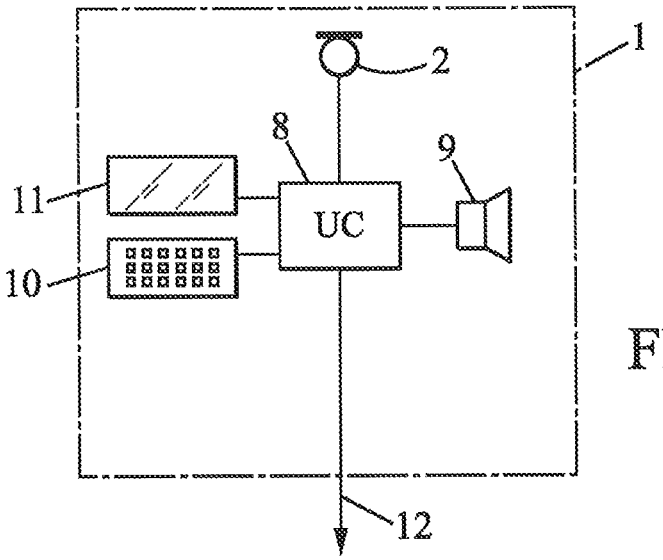
FIG. 2

METHOD AND DEVICE FOR ESTIMATING ACOUSTIC REVERBERATION

CROSS-REFERENCE TO RELATED APPLICATION

This Application is a 35 USC § 371 US National Stage filing of International Application No. PCT/FR2016/053034 filed on Nov. 21, 2016, and claims priority under the Paris Convention to French Patent Application No. 15 61404 filed on Nov. 26, 2015.

FIELD OF THE DISCLOSURE

This invention relates to methods and devices for estimating acoustic reverberation.

BACKGROUND OF THE DISCLOSURE

Estimating the acoustic reverberation of an environment is essential for capturing acoustic signals such as speech in a reverberating environment such as for example a room in a building.

When a sound is emitted and then captured by a microphone in a reverberating environment, the microphone captures not only the signal received directly, but also signals reverberating in the environment.

This reverberation is reflected by the impulse response of the environment, from which emerges various known parameters, in particular the reverberation time. The impulse response is directly measurable by emitting an acoustic impulse in the environment, but this method is burdensome and hard to imagine for making repeated measurements while one or more speakers talk in the room.

The reverberation time can be estimated blind, for example while one or more speakers talk. The most commonly used parameter for representing the reverberation time is the reverberation time at 60 dB $RT_{60}$.

As an example, the document US 2014/169,575 describes a method for blind estimation of reverberation time in a room.

However, the reverberation time is not representative of the distance between the emitter and the microphone, which however has a significant impact on the reverberation level. The captured acoustic signals can therefore not be satisfactorily processed with the known methods of the aforementioned type.

SUMMARY OF THE DISCLOSURE

Therefore the purpose of the present invention is to propose a method for estimating the acoustic reverberation with which to avoid this disadvantage.

For this purpose, the invention proposes a method for estimating the acoustic reverberations in an environment comprising the following steps:

(a) a measurement step in which at least one acoustic signal in the environment is captured;

(b) an observation step during which an acoustic energy decay rate distribution is determined from the acoustic signal captured in step (a) and the characteristic function of the acoustic energy decay rate distribution is determined;

(c) an estimation step during which a characteristic reverberation time and a characteristic reverberation level of the sound in the environment are estimated from data representative of the acoustic energy decay rate distribution determined in step (b), where the regression is done with reference to:

- reference characteristic functions representative respectively of several acoustic energy decay rate distributions;
- reference characteristic reverberation times corresponding to said reference characteristic functions; and
- reference characteristic reverberation levels corresponding to said reference characteristic functions.

Because of these arrangements, and in particular because of the fact that the estimation method is applied to the acoustic energy decay rate distribution, both a characteristic reverberation time and a characteristic reverberation level can be reliably determined for the sound in the environment. The captured sound signals can be processed satisfactorily with these two parameters.

In various embodiments of the method according to the invention, one and/or another of the following dispositions can possibly be used:

- during the estimation step (c), a kernel function estimator is used and the characteristic reverberation time and the characteristic reverberation level are determined simultaneously;
- during the estimation step (c), a Nadaraya-Watson estimator is used;
- during the estimation step (c), the characteristic reverberation level of the sound in the environment (7) is chosen among the clarity index $C_\tau$ and the definition index $D_\tau$;
- during the observation step (b), the energy decay rates are determined by calculating the energy $E_m$ of the acoustic signal on successive signal frames m, and then calculating a logarithmic ratio between the energy of two successive frames:

$$\rho(m) = \log\left(\frac{E_m}{E_{m-1}}\right); \tag{5}$$

the method further comprises a preliminary calibration phase comprising the following steps:

(a') at least one initial reference signal determination step in which a plurality of reference acoustic signals corresponding to said reference characteristic reverberation times and said reference characteristic reverberation levels are determined;

(b') at least one initial observation step during which, an acoustic energy decay rate distribution and the reference characteristic function are determined for each reference acoustic signal;

- during said reference signal determination step, at least one part of the reference acoustic signals and the reference characteristic reverberation times and characteristic reverberation levels corresponding to said reference acoustic signals are determined by calculation from a predetermined set of impulse responses;
- during said reference signal determination step, at least one part of the reference acoustic signals, the characteristic reverberation times and the reference characteristic reverberation levels corresponding to said reference acoustic signals are determined by measurement.

Further, an object of the invention is also a device for estimating the acoustic reverberation in an environment, comprising:

(a) means of measurement for capturing at least one acoustic signal emitted in the environment;

(b) means of determination of an acoustic energy decay rate distribution from the acoustic signal captured by the means of measurement, and for determining the characteristic function of the acoustic energy decay rate distribution;

(c) means of estimation of a characteristic reverberation time and a characteristic reverberation level of the sound in the environment from data representative of the acoustic energy decay rate distribution, where the regression is done with reference to:

- reference characteristic functions representative respectively of several acoustic energy decay rate distributions;
- reference characteristic reverberation times corresponding to said reference characteristic functions; and
- reference characteristic reverberation levels corresponding to said reference characteristic functions.

BRIEF DESCRIPTION OF THE DRAWINGS

Other features and advantages of the invention will become apparent during the following description of one of the embodiments thereof, given as a nonlimiting example, with reference to the attached drawings.

In the drawings:

FIG. 1 is a schematic view showing the reverberation of sound in a room when a subject speaks so that their speech is captured by a device according to an embodiment of the invention;

FIG. 2 is a conceptual drawing of the device from FIG. 1.

DETAILED DESCRIPTION OF THE DISCLOSURE

In the various figures, the same references designate identical or similar items.

The purpose of the invention is to estimate the acoustic reverberation of an environment 7, for example a room in a building such as shown schematically in FIG. 1, so as to process the acoustic signals captured by an electronic device 1 provided with a microphone 2. The electronic device 1 can for example be a telephone in the example shown, or a computer or something else.

When the sound is emitted in the environment 7, for example by the person 3, this sound propagates to the microphone 2 along various paths 4, either directly, or after reflection from one or more walls 5, 6 of the environment 7.

As shown in FIG. 2, the electronic device 1 can comprise for example a central electronic unit 8 such as a processor or other, connected to the microphone 2 and various other elements, including for example a speaker 9, keyboard 10 and screen 11. The central electronic unit 8 can communicate with an external network 12, for example a telephone network.

With the invention, the electronic device 1 is able to measure blind two characteristic parameters of the reverberation of the environment 7:

- a characteristic reverberation time, for example the reverberation time at 60 dB $RT_{60}$; and
- a characteristic reverberation level (for example clarity or definition index, or direct signal over reverberated signal index).

These parameters can be used for eliminating the effects of echoes or more generally for optimizing sound signals captured by the microphone 2. The parameters in question are estimated repetitively, so that the device 1 adapts for example to changes of speakers 3, movements of speakers 3, and movements of the device 1 or other objects in the environment 7.

The reverberation time at 60 dB $RT_{60}$ can be defined by the inverse integration method of Manfred R. Schroeder (New Method of Measuring Reverberation Time, The Journal of the Acoustical Society of America, 37(3):409, 1965) by the Energy Decay Curve (EDC):

$$\mathrm{EDC}(n)=\Sigma_{k=n}^{N_h} h(k)^2 \tag{1}$$

where:

- h is the impulse response of the environment of length $N_h$,
- n is a temporal index, for example a number of samples obtained with constant time step sampling; n is included between 1 and $N_h$.

$RT_{60}$ is the time at temporal index n required for EDC(n) to decrease 60 dB.

Although the reverberation time $RT_{60}$ is the most commonly used, another reverberation time characteristic of the environment 7 could be estimated.

The reverberation level is most commonly represented by the clarity index:

$$C_\tau = 10\log_{10}\left(\frac{\sum_{n=0}^{N_\tau} h^2(n)}{\sum_{n=N_\tau+1}^{\infty} h^2(n)}\right)\mathrm{dB}, \tag{2}$$

or by the definition index:

$$D_\tau = 10\log_{10}\left(\frac{\sum_{n=0}^{N_\tau} h^2(n)}{\sum_{n=0}^{\infty} h^2(n)}\right)\mathrm{dB}, \tag{3}$$

where:

- $N_\tau$ is the number of samples at constant time step corresponding to the time $\tau$, generally included between 0.1 ms and 1 s;
- n is a temporal index included between 1 and $N_\tau$, representative of the number of samples of constant time step;
- h(n) is the impulse response of the environment 7.

These indexes were described in particular by P. A. Naylor and N. D. Gaubitch (Speech Dereverberation, Springer, Eds., edition, 2010).

The two most commonly used values of $\tau$ are 50 ms and 80 ms, in particular 50 ms ($C_{50}$ and $D_{50}$ indexes), but other lengths are possible and more generally other indexes reflecting the ratio of direct sound to reverberated sound could be estimated in the method according to the invention, implemented for example by the aforementioned electronic central unit 8.

This method comprises the following steps:

(a) an acoustic signal measurement step;

(b) an observation step during which an acoustic energy decay rate distribution is determined from acoustic signals measured in step (a);

(c) an estimation step during which a characteristic reverberation time and a characteristic reverberation level of sound in the environment 7 are estimated by regression from the acoustic energy decay rate distribution determined in step (b).

(a) Measurement Step:

During this step, the microphone 2 captures "blind" (meaning without prior knowledge of the emitted signals) an acoustic signal broadcast in the environment 7, for example while the speaker 3 talks. The signal is sampled and stored in the processor 8 or an attached memory (not shown).

(b) Observation Step:

During this step, an acoustic energy decay rate distribution is determined from the acoustic signal measured in step (a);

To do that, the reverberated signal energy envelope $d_x(n)$ is determined such as described in particular by Wen et al. (J. Y. C. Wen, E. A. P. Habets, and P. A. Naylor, Blind estimation of reverberation time based on the distribution of signal decay rates, Acoustics, Speech and Signal Processing, 2008, ICASSP 2008, IEEE International Conference pages 329-332, March 2008).

By doing a calculation on the signal sample frames $N_\omega$ separated by jumps of R signal samples, a total energy of the frame m can be calculated with the formula:

$$E_m=\Sigma_{i=0}^{N_\omega-1}d_x(mR+i) \tag{4}$$

and next estimate the energy decay rate by calculating the logarithmic ratio of two successive frames:

$$\lambda_x \approx \rho(m) = \log\left(\frac{E_m}{E_{m-1}}\right). \tag{5}$$

In fact, the energy envelope $d_x(n)$ can be expressed by the formula:

$$d_x(n) = \begin{cases} (e^{\lambda_h n} - e^{\lambda_s n})/(\lambda_h - \lambda_s) & \text{if } \lambda_h \neq \lambda_s \\ ne^{\lambda_h n}s & \text{if } \lambda_h = \lambda_s \end{cases} \tag{6}$$

where $\lambda_s$ and $\lambda_h$ are respectively the energy decay rate of the anechoic signal emitted and of the environment 7 (the captured signal is a convolution of the emitted anechoic signal (speech) with the impulse response of the environment between the speaker 3 and the microphone 2, where n is the previously defined temporal index).

Since the sum is dominated by the exponential term corresponding to the largest value of λ, the energy decay rate of the reverberated signal $\lambda_x$ can be approximated by:

$$\lambda_x=\max[\lambda_h,\lambda_s] \tag{7},$$

which justifies the formula (5) above.

The calculation of ρ(m) can typically be done on a number of frames, M, at least 2000, corresponding to at least 1 min. of signal depending on the selected analysis parameters. The frames can have an individual length of 10 to 100 ms, in particular of order 32 ms. The frames can mutually overlap, for example with an overlap rate of order 50% between successive frames.

The result is thus different values of the energy decay rate ρ(m), which have some statistical distribution (number of executions, or probability of execution depending on the energy decay rate ρ(m), as discussed for example in the article by Wen et al. above).

The characteristic function of the energy decay rate distribution is next determined by the following formula (see Audrey Feuerverger and Roman A. Mureika [The empirical characteristic function and its applications, Ann. Statist., 5(1):88-97, 01 1977]):

$$\phi_X(f)=\int e^{ifx}dF_X(x)=E[e^{ifx}] \tag{8}$$

where X here represents the aforementioned energy decay rate ρ(m) estimated for various values of m (formula (5)), $F_X$ represents the cumulative distribution of X and f is a dimensionless variable generally called angular frequency.

The characteristic function can be calculated for angular frequencies f ranging for example from 0 to 0.4, by increments of 0.001.

(c) Estimation step:

Start with the characteristic function $\Phi_{\rho(m)}(f)$, calculated for p/2 frequencies f (where p is an even integer), where the frequency range f and their sampling are intended such that $|\Phi_{\rho(m)}(f)|$ is preferably included between 0.1 and 1.

Typically, p can be included between 256 and 2048.

Because the characteristic function is a complex number, it can be represented by a vector X from $\mathbb{R}^p$, constituting the random input vector x of the estimator used. The random output vector y of the estimator, belonging to $\mathbb{R}^2$, has the two estimated parameters as its components, for example ($RT_{60}$, $C_{50}$) or ($RT_{60}$, $D_{50}$).

The estimator used can advantageously be a kernel function estimator, for example a Nadaraya-Watson estimator. Such an estimator has the advantage of simultaneously determining the characteristic reverberation time and the characteristic reverberation level.

The estimator in question can be determined in advance in an initial calibration phase, where at least one initial step of reference signal determination (a') and at least one initial step of observation (b') is implemented.

During the initial step of reference signal determination a plurality of reference acoustic signals, and corresponding reference characteristic reverberation times and reference characteristic reverberation levels are determined.

During the initial observation step, the acoustic energy decay rate distribution and the reference characteristic function are determined for each reference acoustic signal in away identical or similar to the aforementioned observation step (b).

The reference acoustic signals are N generally voice signals and correspond to N different scenarios (e.g. different speakers, different positions, different environments 7). N can be several hundred or even several thousand.

The initial reference signal determination step can be done:

- with new real measurements done for example with an electronic device 1 of a fixed model (in this case, the characteristic reverberation time and the characteristic reverberation level can also be measured);
- and/or with synthetic acoustic signals.

In the case of real measurements, these will not generally be done in the specific environment 7 where the electronic device 1 will be used, even though this scenario can be considered.

The aforementioned synthetic acoustic signals can be calculated by convolution of the prerecorded impulse responses with anechoic speech signals, also prerecorded, coming from different speakers. Prerecorded impulse responses can, for example, come from impulse response databases, for example, coming from free access databases such as the databases: Aachen Impulse Response (http://www.openairlib.net/auralizationdb), MARDY (Wen et al., Evaluation of speech dereverberation algorithms using the Mardy database, September IWAENC 2006, Paris), QueenMary (R. Stewart and M. Sandler, Database of omnidirectional and b-format room impulse responses, In Acoustics Speech and Signal Processing (ICASSP). 2010 IEEE International Conference on., pages 165-168, March 2010), for example with reverberation times $RT_{60}$ ranging from 0.3 s to 8 s and clarity indexes $C_{50}$ from −10 dB to 25 dB. The anechoic speech signals recorded from various speakers, for example various ages and genders, with for example recording lengths for example of a few minutes, for example of order five minutes.

The energy decay rate distributions can for example be calculated on 10 to 100 ms frames, in particular of order 32 ms. The frames can mutually overlap, for example with an overlap rate of order 50% between successive frames. The characteristic functions can be calculated for angular frequencies f ranging for example from 0 to 0.4, by increments of 0.001.

In that way N executions of the aforementioned x and y vectors result and the Nadaraya-Watson estimator can then be determined with the formula:

$$\hat{f}(x) = \frac{\sum_{i=1}^{N} y_i K_\lambda(x, x_i)}{\sum_{i=1}^{N} K_\lambda(x, x_i)}. \tag{9}$$

where:

$x_i$, $y_i$, i=1 to N, are the N executions of the vectors x, y used for the calibration step;

$K_\lambda(x, x_i)$ is a kernel function with window X (where X is a constant also called smoothing parameter);

x is the unknown input vector (measurement done at the measurement step (a) in order to estimate the vector y with the formula $y=\hat{f}(x)$).

The kernel function $K_\lambda(x, x_i)$ is a function of x and $x_i$ such as defined in particular by Scholkopf et al. (B. Scholkopf and A. J. Smola, Learning with Kernels, MIT Press, Cambridge, Mass., 2001).

The Gaussian kernel can in particular be used, for example with a window of $\lambda=5\cdot10^{-4}$ (nonlimiting example):

$$K_\lambda(x, x_i) = \frac{1}{\lambda} e^{\frac{-\|x-x_i\|^2}{2\lambda}}.$$

The tests performed show that the method from the invention is more precise than the methods from the prior art for the determination of reverberation time and it further serves to determine the reverberation level at the same time as the reverberation time, which is a significant improvement.

The invention claimed is:

1. A method for estimating acoustic reverberations in an environment comprising the following steps:

(a) a measurement step in which at least one acoustic signal emitted in the environment is captured by at least one microphone and transmitting said acoustic signal to at least one processor;

(b) an observation step during which an acoustic energy decay rate distribution is determined by said at least one processor from the acoustic signal captured in step (a) and a characteristic function of the acoustic energy decay rate distribution is determined;

(c) an estimation step during which a characteristic reverberation time and a characteristic reverberation level of the sound in the environment thereof are estimated by said at least one processor, by regression from said characteristic function determined in step (b), where the regression is done with reference to:

reference characteristic functions representative respectively of several acoustic energy decay rate distributions;

reference characteristic reverberation times corresponding to said reference characteristic functions; and reference characteristic reverberation levels corresponding to said reference characteristic functions; wherein said characteristic reverberation time and said characteristic reverberation level are then used by said at least one processor for optimizing sound signals captured by the microphone.

2. The method according to claim 1 wherein during the estimation step (c), a kernel function estimator is used and the characteristic reverberation time and the characteristic reverberation level are determined simultaneously.

3. The method according to claim 2 wherein during the estimation step (c), a Nadaraya-Watson estimator is used.

4. The method according to claim 1 wherein during the estimation step (c), the characteristic reverberation level of the sound in the environment is chosen among a clarity index $C\tau$ and a definition index $D\tau$.

5. The method according to claim 1 wherein during the observation step (b), the energy decay rates are determined by calculating an energy Em of the acoustic signal on successive signal frames m, and then calculating a logarithmic ratio between the energy of two successive frames:

$$\rho(m) = \log\left(\frac{E_m}{E_{m-1}}\right).$$

6. The method according to claim 1 further comprises a preliminary calibration phase comprising the following steps:

(a') at least one initial reference signal determination step in which a plurality of reference acoustic signals corresponding to said reference characteristic reverberation times and said reference characteristic reverberation levels are determined;

(b') at least one initial observation step during which, an acoustic energy decay rate distribution and the reference characteristic function are determined for each reference acoustic signal.

7. The method according to claim 6 wherein during said reference signal determination step, at least one part of the reference acoustic signals and the reference characteristic reverberation times and characteristic reverberation levels corresponding to said reference acoustic signals are determined by calculation from a predetermined set of impulse responses.

8. The method according to claim 6 wherein during said reference signal determination step, at least one part of the reference acoustic signals, the characteristic reverberation times and the reference characteristic reverberation levels corresponding to said reference acoustic signals are determined by measurement.

9. A device for estimating acoustic reverberations in an environment comprising:

at least one microphone for capturing at least one acoustic signal emitted in the environment;

at least a processor adapted to receive said acoustic signal from the microphone and adapted to:

determine an acoustic energy decay rate distribution from the acoustic signal captured by the at least one microphone, and for determining a characteristic function of the acoustic energy decay rate distribution;

estimate a characteristic reverberation time and a characteristic reverberation level of the sound in the environment from data representative of the acoustic energy decay rate distribution, where the regression is done with reference to:

reference characteristic functions representative respectively of several acoustic energy decay rate distributions;

reference characteristic reverberation times corresponding to said reference characteristic functions; and reference characteristic reverberation levels corresponding to said reference characteristic functions, use said characteristic reverberation time and said characteristic reverberation level for optimizing sound signals captured by the microphone.

* * * * *